US010876509B2

(12) United States Patent
Han et al.

(10) Patent No.: US 10,876,509 B2
(45) Date of Patent: Dec. 29, 2020

(54) HIGH-PRESSURE FUEL PUMP

(71) Applicant: HYUNDAI KEFICO CORPORATION, Gyeonggi-do (KR)

(72) Inventors: Kyung Chul Han, Seoul (KR); Jin Sung Kim, Seoul (KR); Eun Woo Nah, Incheon (KR); Chun Ky Hong, Gyeonggi-do (KR)

(73) Assignee: HYUNDAI KEFICO CORPORATION, Gyeonggi-do (KR)

( * ) Notice: Subject to any disclaimer, the term of this patent is extended or adjusted under 35 U.S.C. 154(b) by 167 days.

(21) Appl. No.: 16/130,119

(22) Filed: Sep. 13, 2018

(65) Prior Publication Data

US 2019/0085804 A1 Mar. 21, 2019

(30) Foreign Application Priority Data

Sep. 20, 2017 (KR) ..... 10-2017-0121134

(51) Int. Cl.
*F02M 63/00* (2006.01)
*F04B 53/10* (2006.01)
(Continued)

(52) U.S. Cl.
CPC ..... *F02M 63/005* (2013.01); *F02M 59/46* (2013.01); *F04B 53/10* (2013.01);
(Continued)

(58) Field of Classification Search
CPC .... F02M 59/365; F02M 59/46; F02M 63/005; F02M 59/366; F02M 55/04;
(Continued)

(56) References Cited

U.S. PATENT DOCUMENTS 4,577,606 A * 3/1986 Bohringer ..... F02M 59/462 123/467
8,206,131 B2 * 6/2012 Suzuki ..... F02M 59/462 417/307
(Continued)

FOREIGN PATENT DOCUMENTS

JP 4664989 B2 4/2011
JP 2016-056720 A 4/2016
(Continued)

*Primary Examiner* — Nathan C Zollinger
(74) *Attorney, Agent, or Firm* — Mintz Levin Cohn Ferris Glovsky and Popeo, P.C.; Peter F. Corless

(57) ABSTRACT

Disclosed herein is a high-pressure fuel pump. The high-pressure fuel pump includes a housing including a chamber provided to compress fuel supplied thereinto, an inlet flow passage that communicates with the chamber to draw fuel into the chamber through the inlet flow passage, and a discharge flow passage that communicates with the chamber to discharge the fuel out of the chamber through the discharge flow passage. The high-pressure fuel pump further includes a piston disposed in the housing and configured to linearly reciprocate to compress the fuel supplied into the chamber; and a discharge valve disposed in the discharge flow passage of the housing and configured to open when a pressure of fuel stored in the chamber is equal to or greater than a first pressure, the discharge valve including an open-and-close member that makes line contact with an inlet of the discharge valve to close the inlet.

8 Claims, 9 Drawing Sheets

(51) Int. Cl.

| | |
|---|---|
| ***F02M 59/46*** | (2006.01) |
| ***F02M 59/36*** | (2006.01) |
| ***F02M 55/04*** | (2006.01) |
| ***F02M 59/02*** | (2006.01) |

(52) U.S. Cl.
CPC ..... *F04B 53/101* (2013.01); *F02M 55/04* (2013.01); *F02M 59/027* (2013.01); *F02M 59/366* (2013.01); *F02M 59/462* (2013.01)

(58) Field of Classification Search
CPC .. F02M 59/462; F02M 59/027; F02M 59/102; F02M 59/025; F02M 59/44; F02M 59/10; F02M 59/20; F02M 59/447; F04B 11/00; F04B 11/008; F04B 11/0016; F04B 53/10; F04B 53/101; F16K 17/0406; F02D 41/3845
USPC ..... 417/307, 559
See application file for complete search history.

(56) References Cited

U.S. PATENT DOCUMENTS

| | | | | |
|---|---|---|---|---|
| 9,291,162 | B2 * | 3/2016 | Usui | F04B 53/1002 |
| 9,328,723 | B2 * | 5/2016 | Oikawa | F02M 69/54 |
| 2011/0315005 | A1 * | 12/2011 | Oikawa | F02M 63/005 91/420 |

FOREIGN PATENT DOCUMENTS

| | | | |
|---|---|---|---|
| KR | 2012-0018396 | A | 3/2012 |
| KR | 10-1182131 | B1 | 9/2012 |
| KR | 2016-0034325 | A | 3/2016 |

* cited by examiner

HIGH-PRESSURE FUEL PUMP

CROSS-REFERENCE TO RELATED APPLICATION

This application claims priority to Korean Patent Application No. 10-2017-0121134, filed on Sep. 20, 2017, the disclosure of which is incorporated herein by reference in its entirety.

TECHNICAL FIELD

The present disclosure relates to a high-pressure fuel pump, and more particularly, to a high-pressure fuel pump which is applied to a direct injection gasoline engine and configured to compress fuel at a high pressure to inject the fuel into a combustion chamber at a high pressure.

RELATED ART

Gasoline direct injection (GDI) engine technology is being developed so as to improve in fuel efficiency and performance of gasoline engines. Unlike typical gasoline engines which generate power through a process of intake, compression, ignition, explosion, and exhaust of air/fuel mixture, GDI engines intake and compress only air and then inject fuel. This scheme is similar to a compression ignition scheme of a diesel engine. Therefore, the GDI engines may embody a high compression ratio exceeding the limit of a compression ratio of typical gasoline engines, thus making it possible to maximize the fuel efficiency. In the GDI engines, a fuel pressure is an important factor. To this end, a high-performance high-pressure fuel pump is needed.

A conventional high-pressure fuel pump is mounted to a camshaft of an engine and configured such that a pump shaft is rotated by the rotational force of a cam of the engine, and a piston of the pump is operated by the rotational force to increase the pressure of gasoline fuel and supply the gasoline fuel at an increased pressure. However, the conventional high-pressure fuel pump increases the production cost due to a three-piston structure.

Accordingly, a single-piston type high-pressure fuel pump for GDI engines using a single pump piston was proposed. FIG. 1 is a sectional view schematically illustrating a conventional high-pressure fuel pump for GDI engines in the related art. Referring to FIG. 1, the conventional high-pressure fuel pump 10 for GDI engines in the related art is mounted to a camshaft (not shown) of an engine and configured such that a piston 71 linearly reciprocates upward and downward by the rotational force of a cam of the engine to increase the pressure of gasoline fuel and supply the gasoline fuel to an injector (not shown) at an increased pressure.

In particular, in the high-pressure fuel pump 10 for GDI engines, a damper 30 is disposed in an upper portion of a housing 20. When fuel is supplied to the damper 30 through an inlet port 81 provided in the damper 30, the pulsation of supplied fuel is reduced in the damper 30. Furthermore, a flow rate control valve 40 is disposed in an inlet flow passage 22 formed in the housing 20. The flow rate control valve 40 controls the inlet flow passage 22 to draw fuel from the damper 30 into a chamber 21 formed in the housing 20. A discharge valve 50 and a discharge port 82 are disposed in a discharge flow passage 23 formed in the housing 20. When the pressure of fuel stored in the chamber 21 is equal to or greater than a predetermined pressure, the discharge valve 50 opens to discharge fuel to the discharge flow passage 23. The discharge port 82 is coupled to the injector so that high-pressure compressed and discharged fuel can be supplied to the injector through the discharge flow passage 23. Here, the piston 71 and a return spring 72 are provided in the housing 20 to compress fuel stored in the chamber 21 to a high pressure.

The discharge valve 50 includes a valve body 51, a valve sleeve 53, an open-and-close member 52, and a spring 54. The valve body 51 is inserted into and coupled to the discharge flow passage 23 and has an inlet through which fuel is drawn into the valve body 51. The valve sleeve 53 is coupled to the valve body 51 and has an outlet through which fuel is discharged out of the valve sleeve 53. The open-and-close member 52 is disposed between the valve body 51 and the valve sleeve 53 to open or close the inlet. The spring 54 applies an elastic force to the open-and-close member 52 to allow the open-and-close member 52 to abut the inlet. The open-and-close member 52 has a planar shape and thus makes surface contact with the inlet to close the inlet.

Due to the open-and-close member 52 making surface contact with the inlet and openably close the inlet, a fluid sticking occurs on a region in which the open-and-close member 52 makes surface contact with the inlet. If the fluid sticking occurs, fluid discharge noises are increased and the sealing performance of the valve is deteriorated.

SUMMARY

The present disclosure provides a high-pressure fuel pump in which an open-and-close member of a discharge valve is configured to make line contact with an inlet, thus preventing a fluid sticking from occurring. Objects and advantages of the present disclosure may be understood by the following description, and become apparent with reference to the exemplary embodiments of the present disclosure. Also, it is obvious to those skilled in the art to which the present disclosure pertains that the objects and advantages of the present disclosure may be realized by the means as claimed and combinations thereof.

In accordance with an aspect of the present disclosure, a high-pressure fuel pump may include a housing, the housing including a chamber provided to compress fuel supplied thereinto, an inlet flow passage that communicates with the chamber to draw fuel into the chamber through the inlet flow passage, and a discharge flow passage that communicates with the chamber to discharge the fuel out of the chamber through the discharge flow passage. The high-pressure fuel pump may also include a piston disposed in the housing and configured to linearly reciprocate to compress the fuel supplied into the chamber; and a discharge valve disposed in the discharge flow passage of the housing and configured to open when a pressure of fuel stored in the chamber is equal to or greater than a first pressure, the discharge valve including an open-and-close member that makes line contact with an inlet of the discharge valve to close the inlet.

The discharge valve may further include a valve housing inserted into and coupled to the discharge flow passage, and having the inlet through which fuel is drawn into the valve housing; the open-and-close member slidably disposed in the valve housing to open or close the inlet, and having a ball shape to make line contact with the inlet; a valve sleeve inserted into and coupled to the discharge flow passage, and having an outlet through which fuel is discharged out of the discharge valve; and a spring disposed between the open-and-close member and the valve sleeve, and configured to be compressed when a pressure of fuel discharged to the discharge flow passage is equal to or greater than the first pressure.

Further, the valve housing may include a housing body formed in a cylindrical shape, and having in a front surface thereof the inlet having a diameter less than a diameter of the open-and-close member, the housing body having an open rear surface; a plurality of guide parts radially formed on an inner circumferential surface of the housing body at positions spaced apart from each other at regular angular intervals, the plurality of guide parts abutting an outer circumferential surface of the open-and-close member to guide movement of the open-and-close member; and flow passage parts formed between the plurality of guide parts and having a radius greater than a radius of the open-and-close member from a center of the housing body, the flow passage parts allowing fuel to flow therethrough when the open-and-close member opens the inlet.

The discharge valve may control a stroke in which the open-and-close member is configured to move when the pressure of fuel stored in the chamber is equal to or greater than the first pressure. To this end, the valve sleeve may include a sleeve body having a cylindrical shape and including an open front surface, with an outlet formed in a rear surface of the sleeve body to discharge fuel out of the sleeve body through the outlet, the sleeve body being inserted into and coupled to the discharge flow passage at a position spaced apart from the housing body by a predetermined distance; and a stopper that protrudes from a central portion of the sleeve body toward the open-and-close member, with the spring fitted over the stopper, the stopper being configured to limit the stroke of the open-and-close member, wherein the stroke of the open-and-close member may be controlled by adjusting a position of the sleeve body coupled to the discharge flow passage.

Alternatively, the valve sleeve may include a sleeve body having a cylindrical shape and including an open front surface, with an outlet formed in a rear surface of the sleeve body to discharge fuel out of the sleeve body through the outlet, the sleeve body being coupled to the housing body by threaded coupling; and a stopper that protrudes from a central portion of the sleeve body toward the open-and-close member, with the spring fitted over the stopper, the stopper being configured to limit the stroke of the open-and-close member, wherein the stroke of the open-and-close member may be controlled by rotating the sleeve body and adjusting a distance between the sleeve body and the housing body.

The high-pressure fuel pump may further include a damper disposed on an upper portion of the housing, and configured to reduce pulsation of fuel drawn thereinto through an inlet port and then supply the fuel to the inlet flow passage of the housing; a sleeve coupled to the housing and configured to support the piston and form a space for storing fuel with the housing; and a pressure relief valve disposed in a relief flow passage formed in the housing to communicate with the discharge flow passage and the space, the pressure relief valve being configured to open when a pressure of fuel supplied into the discharge flow passage is equal to or greater than a second pressure.

Furthermore, a damper aperture that communicates with the damper and the space may be formed in the housing, and the relief flow passage may be formed to communicate with the discharge flow passage and the damper aperture. Based on a plan view of the housing perpendicular to the piston, the relief flow passage may be inclined at a predetermined angle with respect to the discharge flow passage.

The pressure relief valve may include a valve body inserted into and coupled to the relief flow passage, and having a through hole through which fuel flows; an open-and-close member configured to open or close the through hole of the valve body; and a spring including a first end supported by the open-and-close member, and a second end supported in the damper aperture, the spring being elastically compressed when a pressure of fuel drawn into the relief flow passage is equal to or greater than a second pressure.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION

Figure 1:
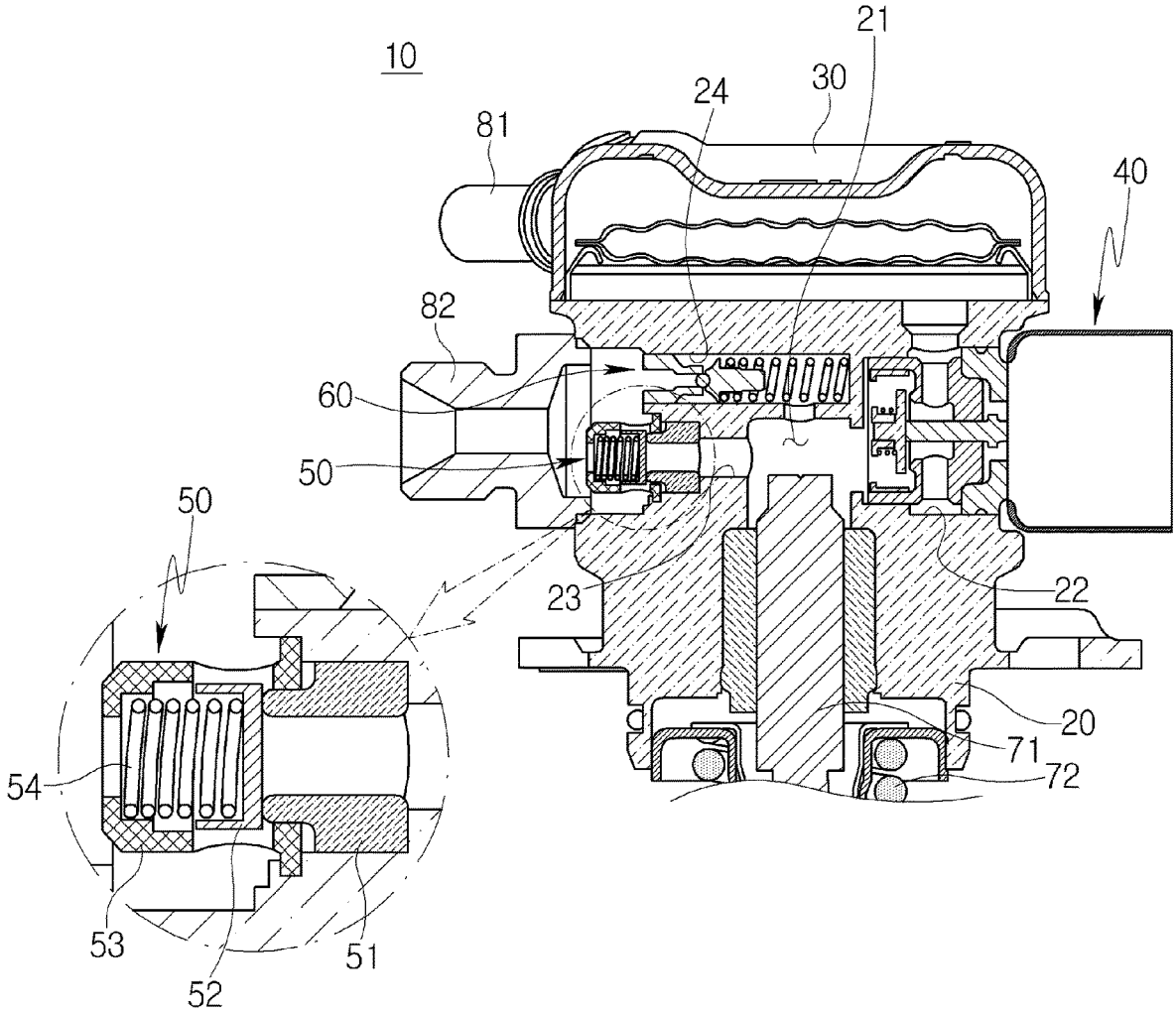
FIG. 1 Related Art
FIG. 1 is a sectional view schematically illustrating a high-pressure fuel pump for GDI engines in the related art.

Advantages and features of the present disclosure and a method of achieving the same will become apparent with reference to the attached drawings and embodiments described below in detail. However, the present disclosure is not limited to the embodiments described below and may be embodied with a variety of different modifications. The embodiments are merely provided to allow one of ordinary skill in the art to completely understand the scope of the present disclosure and are defined by the scope of the claims.

Accordingly, in some embodiments, well-known operations of a process, well-known structures, and well-known technologies will be not described in detail to avoid obscuring understanding of the present disclosure.

The terms used herein are for explaining embodiments but are not intended to limit the present disclosure. Throughout the specification, unless particularly defined otherwise, singular forms include plural forms. The terms "comprises" and/or "comprising" are used herein as meanings which do not exclude presence or addition of one or more other components, stages, and/or operations in addition to stated components, stages, and/or operations. Also, "and/or" includes each and one or more combinations of stated items.

Also, embodiments disclosed herein will be described with reference to perspective views, cross-sectional views, side views, and/or schematic diagrams which are exemplary views of the present disclosure. Accordingly, modifications may be made in the forms of exemplary views by manufacturing technology, allowable error, and/or the like. Accordingly, the embodiments of the present disclosure will not be limited to particular forms shown in the drawings and include changes made by a manufacturing process. Also, throughout the drawings of the present disclosure, components may be slightly exaggerated or reduced in consideration of convenience of description.

In the drawings, the width, length, thickness, etc. of each element may have been enlarged for convenience. Furthermore, when it is described that one element is disposed 'over' or 'on' the other element, one element may be disposed 'right over' or 'right on' the other element or a third element may be disposed between the two elements. The same reference numbers are used throughout the specification to refer to the same or like parts.

Figure 2:
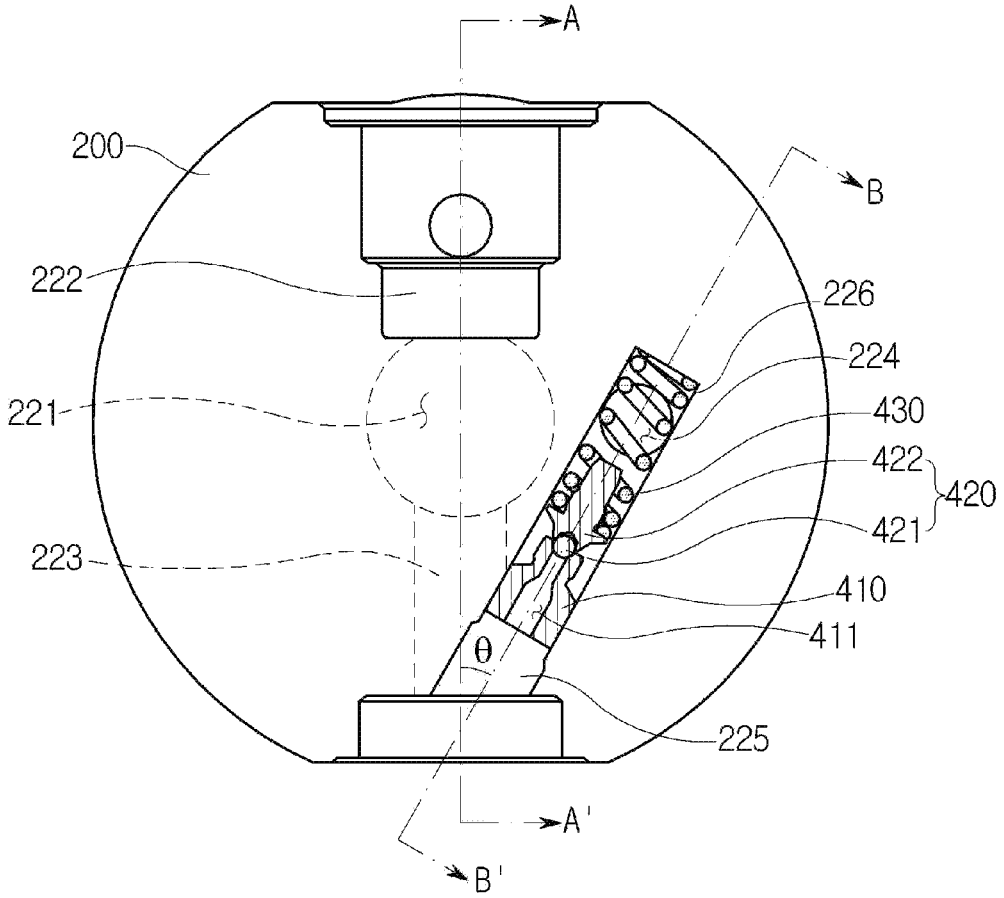
FIG. 2 is an exemplary sectional plan view schematically illustrating installation of a pressure relief valve in a housing of a high-pressure fuel pump in accordance with an exemplary embodiment of the present disclosure.
Figure 3:
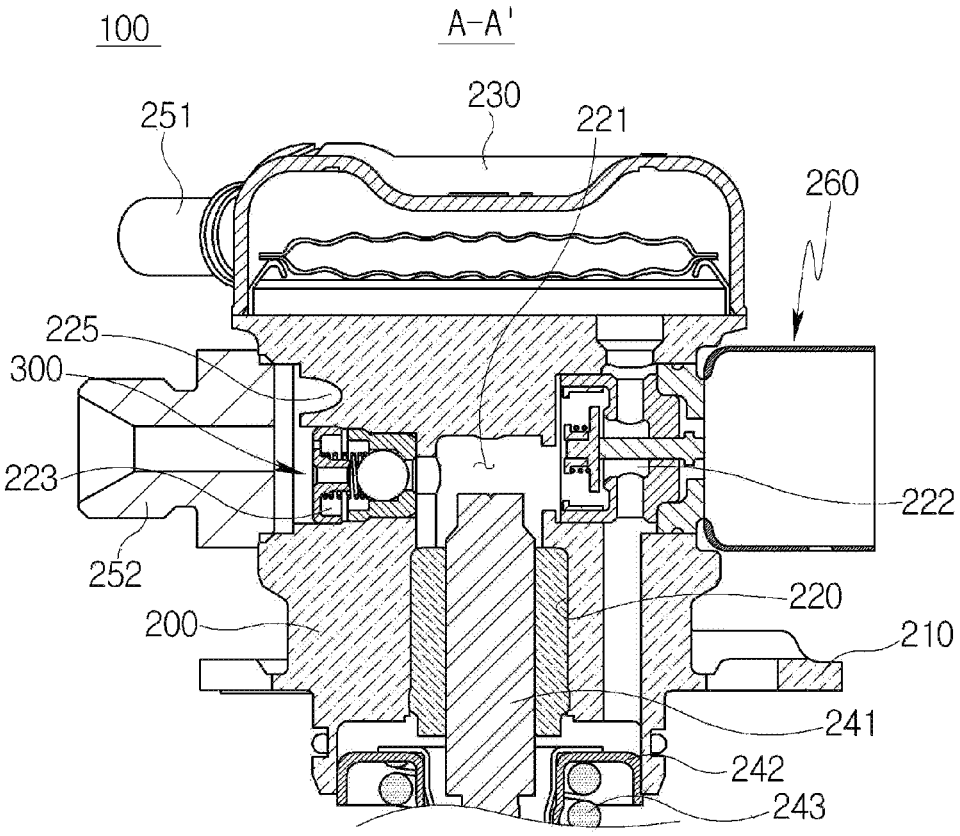
FIG. 3 is an exemplary schematic sectional view taken along line A-A' of FIG. 2 to illustrate the high-pressure fuel pump in accordance with the exemplary embodiment of the present disclosure.
Figure 4:
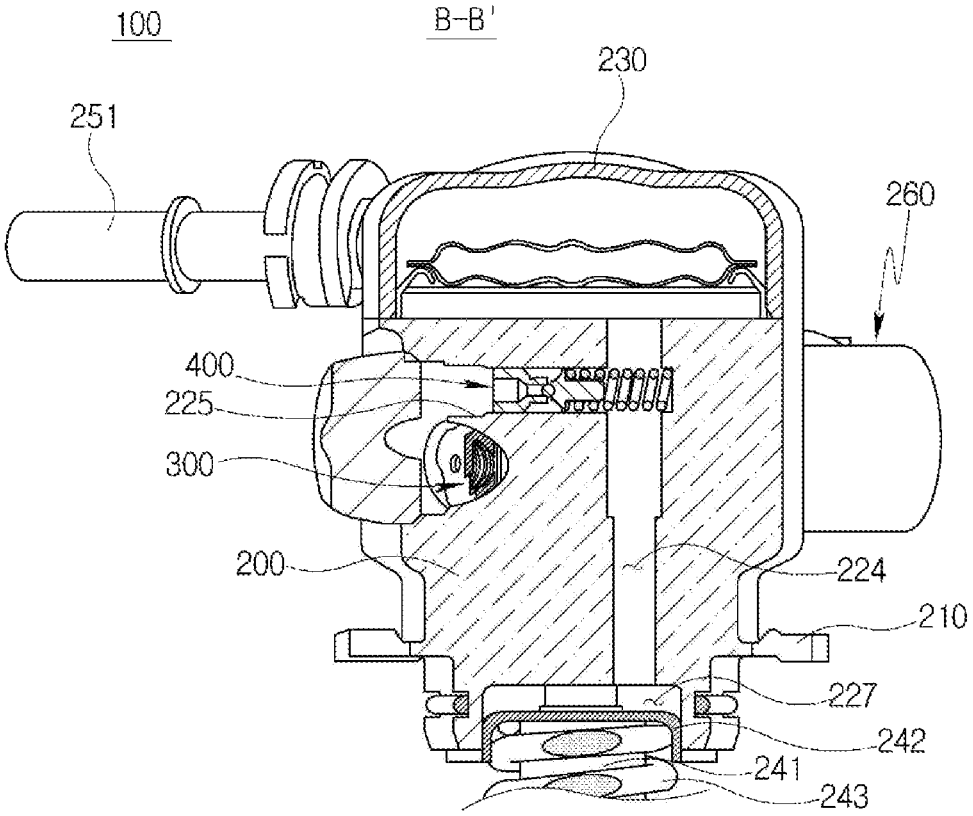
FIG. 4 is an exemplary schematic sectional view taken along line B-B' of FIG. 2 to illustrate the high-pressure fuel pump in accordance with the exemplary embodiment of the present disclosure.
Figure 5:
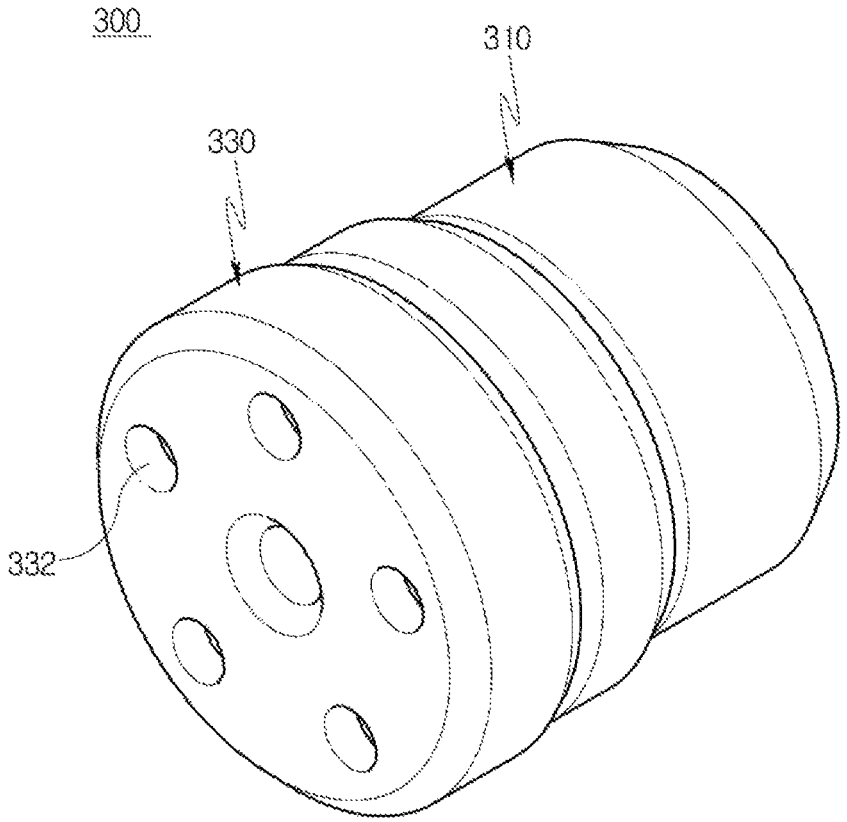
FIG. 5 is an exemplary perspective view schematically illustrating a discharge valve of the high-pressure fuel pump in accordance with the exemplary embodiment of the present disclosure.
Figure 6:
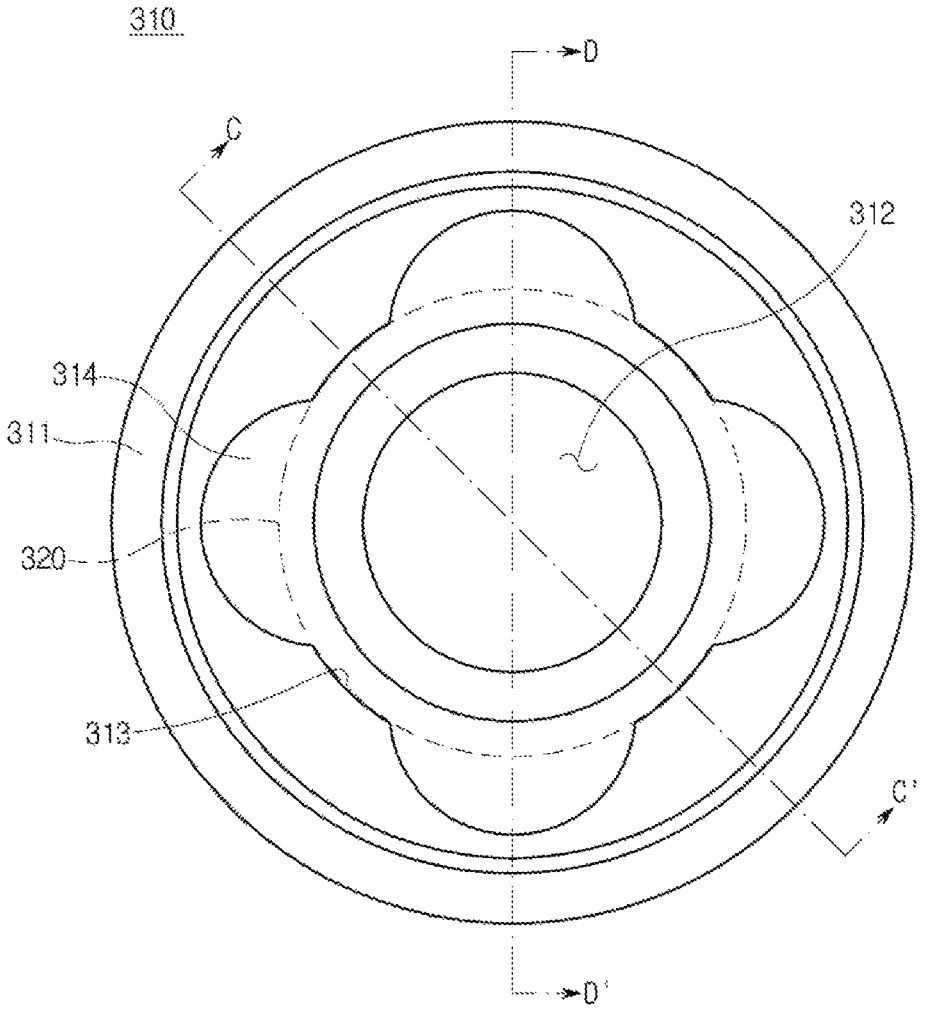
FIG. 6 is an exemplary plan view schematically illustrating a valve housing of the discharge valve of the high-pressure fuel pump in accordance with the exemplary embodiment of the present disclosure.
Figure 7:
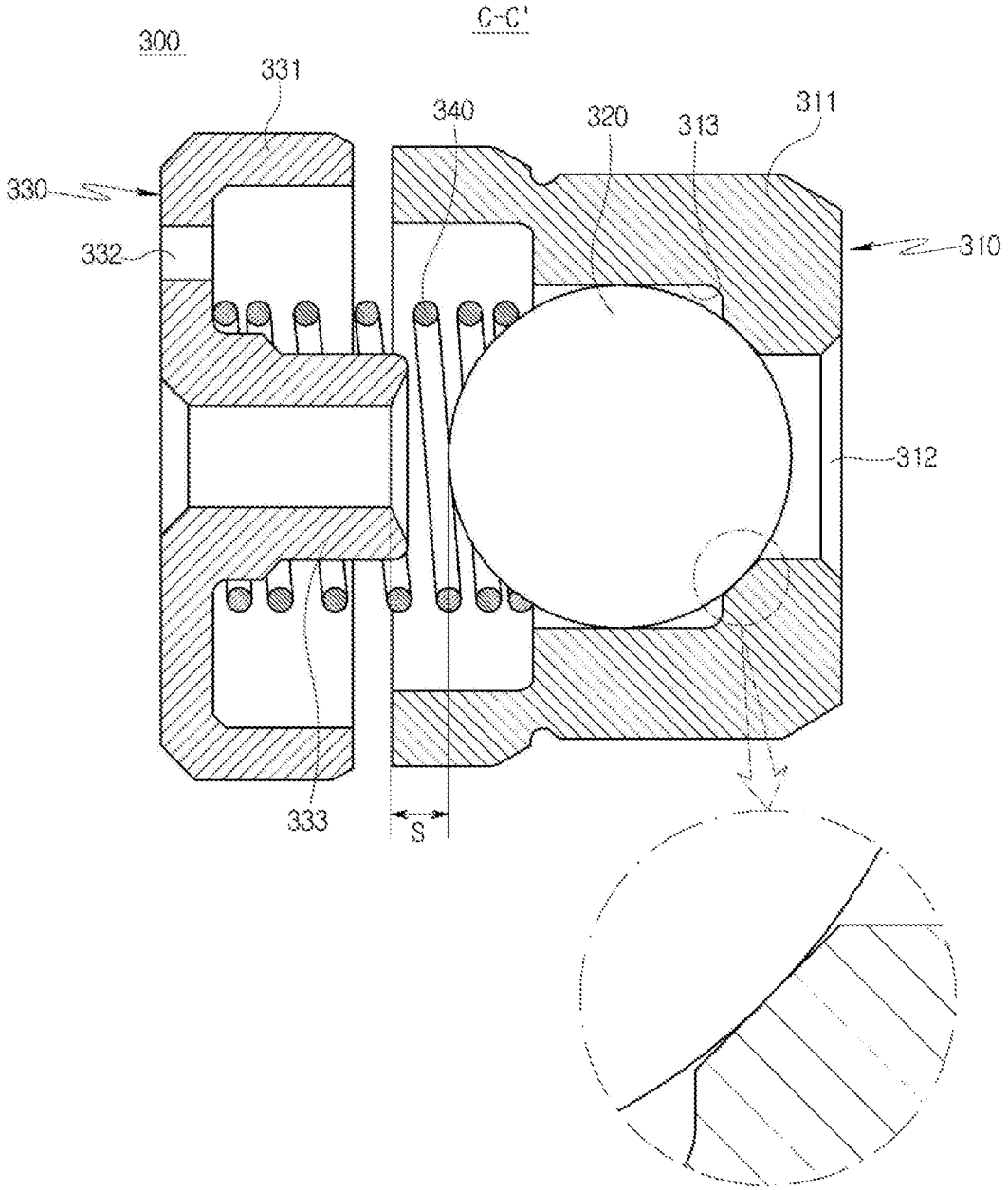
FIG. 7 is an exemplary schematic sectional view taken along line C-C' of FIG. 6 to illustrate the discharge valve of the high-pressure fuel pump in accordance with the exemplary embodiment of the present disclosure.
Figure 8:
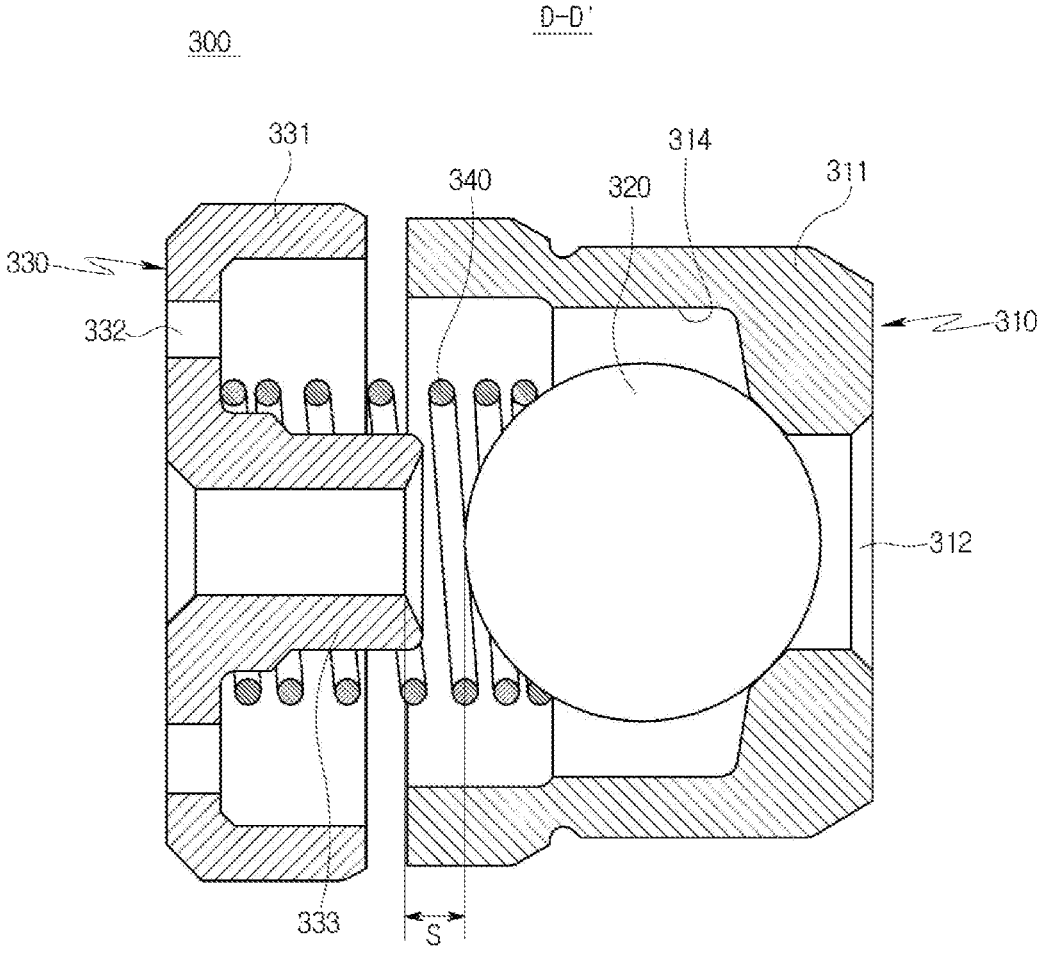
FIG. 8 is an exemplary schematic sectional view taken along line D-D' of FIG. 6 to illustrate the discharge valve of the high-pressure fuel pump in accordance with the exemplary embodiment of the present disclosure.
Figure 9:
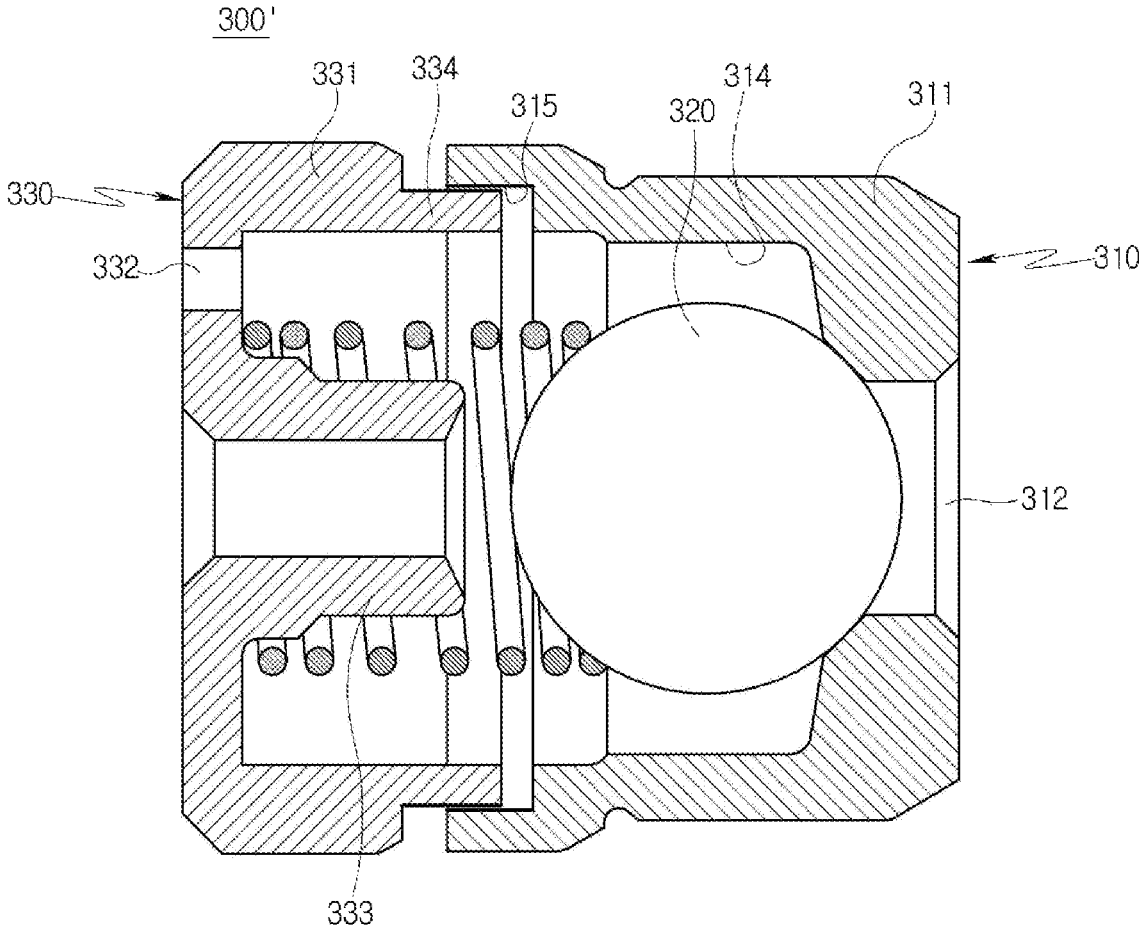
FIG. 9 is an exemplary sectional view schematically illustrating another exemplary embodiment of the discharge valve of the high-pressure fuel pump in accordance with the present disclosure.

FIG. 2 is an exemplary sectional plan view schematically illustrating installation of a pressure relief valve in a housing of a high-pressure fuel pump in accordance with an exemplary embodiment of the present disclosure, and FIGS. 3 and 4 are exemplary schematic sectional views taken along respective lines A-A' and B-B' of FIG. 2 to illustrate the high-pressure fuel pump. FIG. 5 is an exemplary perspective view schematically illustrating a discharge valve of the high-pressure fuel pump in accordance with the exemplary embodiment of the present disclosure, and FIG. 6 is an exemplary plan view schematically illustrating a valve housing of the discharge valve of the high-pressure fuel pump in accordance with the exemplary embodiment of the present disclosure. FIGS. 7 and 8 are exemplary schematic sectional views taken along respective lines C-C' and D-D' of FIG. 6 to illustrate the discharge valve of the high-pressure fuel pump. FIG. 9 is an exemplary sectional view schematically illustrating another exemplary embodiment of the discharge valve of the high-pressure fuel pump in accordance with the present disclosure.

Referring to FIGS. 2 to 8, the high-pressure fuel pump 100 in accordance with an exemplary embodiment of the present disclosure may include a housing 200, a piston 241, and a discharge valve 300. The housing 200 may compress fuel drawn thereinto. The piston 241 may compress fuel supplied into the housing 200. The discharge valve 300 may be provided in a discharge flow passage 223 of the housing 200 to open or close the discharge flow passage 223. The high-pressure fuel pump 100 may further include a flow rate control valve 260 which is provided in an inlet flow passage 222 of the housing 200 to open or close the inlet flow passage 222 and supply fuel to the chamber 221 at a predetermined flow rate.

The housing 200 may include a cylindrical shape and may be mounted to an engine (not shown) by a flange part 210 that protrudes outward form the housing 200. Furthermore, the housing 200 may include therein a hollow part 220 which is open toward only one side. The piston 241 may be inserted into the hollow part 220 and configured to linearly reciprocate within the hollow part 220.

In the housing 200, a chamber 221 may be formed in an inner end of the hollow part 220 to allow fuel to be drawn into and stored in the chamber 221. One side surface of the chamber 221 may communicate with the inlet flow passage 222 through which fuel is supplied into the chamber 221, and another side surface of the chamber 221 may communicate with the discharge flow passage 223 through which fuel is discharged out of the chamber 221. In other words, referring to the drawings, the chamber 221 may be formed in an inner central portion of the housing 200, and the inlet flow passage 222 and the discharge flow passage 223 may be radially formed in the housing 200 while communicating with the chamber 221.

In particular, the inlet flow passage 222 may be connected with the damper 230 to allow fuel supplied from the damper 230 to be stored in the inlet flow passage 222. The flow rate control valve 260 may be disposed in the inlet flow passage 222 to adjust the flow rate of fuel that is supplied into the chamber 221. In addition, a discharge port 252 may be provided on the discharge flow passage 223 to allow fuel discharged from the discharge flow passage 223 to be supplied to the discharge port 252. The discharge port 252 may be coupled to an injector (not shown) to supply high-pressure fuel to the injector.

The piston 241 may be inserted into the hollow part 220 of the housing 200 and configured to linearly reciprocate within the hollow part 220 to compress fuel supplied into the chamber 221 of the housing 200. In particular, the piston 241 may be coupled to a cam shaft (not shown) of the engine and may be displaced upward by the cam shaft and displaced downward by the elastic force of a return spring 243 provided on the piston 241. In other words, the piston 241 may linearly reciprocate within the housing and may be displaced upward by the camshaft of the engine, and displaced downward by the elastic force of the return spring 243, and then displaced upward by the camshaft again. By this motion, the piston 241 may compress fuel supplied into the chamber 221 to a high pressure.

The discharge valve 300 may be disposed in the discharge flow passage 223 of the housing 200 and configured to open when the pressure of fuel stored in the chamber 221 is equal to or greater than a first pressure. Furthermore, the discharge valve 300 may include a structure to allow the stroke of an open-and-close part 320 to be adjusted. Accordingly, when fuel stored in the chamber 221 is compressed to the first pressure that is a target pressure, the discharge valve 300 may open to discharge the fuel.

In particular, the discharge valve 300 may include a valve housing 311, the open-and-close member 320, a valve sleeve 330, and a spring 340. The valve housing 311 may be inserted into and coupled to the discharge flow passage 223 and may include an inlet 312 through which fuel is drawn into the valve housing 311. The open-and-close member 320 may be slidably disposed in the valve housing 311 to open or close the inlet 312. The valve sleeve 330 may include an outlet 332 through which fuel is discharged out of the valve sleeve 330. The valve sleeve 330 may be disposed such that the distance between the valve sleeve 330 and the valve housing 310 may be adjusted to control the stroke S of the open-and-close member 320. The spring 340 may be disposed between the open-and-close member 320 and the valve sleeve 330 and may be elastically compressed when the pressure of fuel discharged through the discharge flow passage 223 is equal to or greater than a first pressure. The open-and-close member 320 may include a ball shape (e.g., substantially a spherical shape) and may make line contact with the inlet 312 and close the inlet 312. In other words, as shown in FIG. 7, the open-and-close member 320 having a curved surface may abut an inner inclined surface of the inlet 312 having a planar surface, and thereby the abuttal may be along a line.

In the high-pressure fuel pump in the related art, referring to FIG. 1, the open-and-close member 52 of the discharge valve 50 has a planar shape and thus make surface contact with the inlet of the valve body 51. Accordingly, a fluid sticking occurs, whereby fluid discharge noises are increased and the sealing is compromised. Conversely, in the present disclosure, the open-and-close member 320 may be formed in a ball shape to allow the open-and-close member 320 to make line contact with the inlet 312, thus preventing a fluid sticking from occurring. Therefore, fluid discharge noises may be prevented from increasing due to the fluid sticking, and the contact pressure in the junction between the open-and-close member 320 and the inlet 312 may be increased and enhance the sealing.

The valve housing 310 may include a housing body 311 having a cylindrical shape. The inlet 312 having a diameter less than that of the open-and-close member 320 may be formed in a front surface of the housing body 311. The housing body 311 may include an open rear surface. A plurality of guide parts 313 may be radially formed on an inner circumferential surface of the housing body 311 at positions spaced apart from each other at regular angular intervals. The guide parts 313 may abut an outer circumferential surface of the open-and-close member 320 and guide movement of the open-and-close member 320. Flow passage parts 314 may be formed between the plurality of guide parts 313 and have a radius greater than that of the open-and-close member 320 from the center of the housing body 311. When the open-and-close member 320 opens the inlet 312, fuel may flow through the flow passage parts 314.

In other words, in the valve housing 310, the plurality of guide parts 313 formed on the inner circumferential surface of the housing body 311 may guide the movement of the open-and-close member 320. The flow passage parts 314 each of which is a semicircular depression may be formed between the guide parts 313. Thus, when the open-and-close member 320 is displaced away from the inlet 312 along the guide parts 313 by the pressure of fuel, fuel may be drawn into the valve housing 310 and may flow along the flow passage parts 314. FIG. 6 illustrates an exemplary implementations with four guide parts 313 and four flow passage parts 314, but this illustration is merely an example. The number of guide parts 313 and the number of flow passage parts 314 may be changed in various ways.

The valve sleeve 330 may include a sleeve body 331, and a stopper 333. The sleeve body 331 having a cylindrical shape may include an open front surface and may include the outlet 332 formed in a rear surface of the sleeve body 331 to discharge fuel through the outlet 332. The sleeve body 331 may be inserted into and coupled to the discharge flow passage 223 with a predetermined distance between the sleeve body 331 and the housing body 311. The stopper 333 may protrude from the center of the sleeve body 331 toward the open-and-close member 320. The spring 340 may be fitted over the stopper 333. The stopper 333 may limit the stroke S of the open-and-close member 320.

In the valve sleeve 330 having the above-mentioned configuration, the stroke S of the open-and-close member 320 may be controlled by adjusting the position of the sleeve body 331 that is inserted into and coupled to the discharge flow passage 223. In other words, since the distance between the stopper 333 and the open-and-close member 320 may be controlled by adjusting the position of the sleeve body 331, the stroke S in which the open-and-close member 320 may move when it opens may be controlled and limited.

The stroke S may require adjustment depending on a discharge pressure and a discharge flow rate of fuel. If the stroke S is excessively increased, the impulsive force between the open-and-close member 320 and the inlet 312 is increased when the open-and-close member 320 elastically returns to its original position from an open state. Thereby, an impulsive noise occurs, and the lifetime of the valve is reduced. Therefore, the stroke S may require an appropriate value, and the stroke S may be adjusted as necessary.

The method of adjusting the stroke S is not limited to the above-mentioned example, and may be changed in various ways so long as the distance between the housing body 311 and the sleeve body 331 may be adjusted. For example, the housing body 311 and the sleeve body 331 may be coupled to each other by threaded coupling to allow the stroke S to be adjusted. This embodiment is illustrated in FIG. 9. Referring to FIG. 9, a discharge valve 300' according to another exemplary embodiment may include substantially the same configuration as that of the discharge valve 300 and may couple the housing body 311 and the sleeve body 331 to each other by threaded coupling.

In particular, the valve sleeve 330 may include a coupling part 334 which protrudes toward the housing body 311 and include an external thread on an outer circumferential surface thereof. An internal thread corresponding to the external thread of the coupling part 334 may be formed on an inner surface 315 of the housing body 311 to allow the threaded coupling to be embodied. The sleeve body 331 may include a diameter less than that of the discharge flow passage 223 to allow the sleeve body 331 to be rotated in the discharge flow passage 223. Conversely, the housing body 311 may be fitted into and fixed to the discharge flow passage 223. Hence, the coupling distance between the housing body 311 and the sleeve body 331 can be adjusting by rotating the sleeve body 331 in a threaded coupling manner. Accordingly, the distance between the stopper 333 and the open-and-close member 320 may be adjusted to limit the stroke of the open-and-close member 320.

Furthermore, the high-pressure fuel pump 100 in accordance with an exemplary embodiment of the present disclosure may further include a sleeve 242, a pressure relief valve 400, and a damper 230. The sleeve 242 may be coupled to the housing 200 to form a space 227 with the housing 200. The pressure relief valve 400 may open when the pressure of fuel that is discharged through the discharge flow passage 223 is equal to or greater than a predetermined pressure, thus reducing the pressure of the fuel. The damper 230 may also be included in the housing 200.

The housing 200 may include a relief flow passage 225 which communicates with both the discharge flow passage 223 and the space 227 formed by the sleeve 242 and the housing 200. In particular, a damper aperture 224 that communicates the damper 230 with the space 227 may be formed in the housing 200. The relief flow passage 225 may be formed to communicate with the discharge flow passage 223 and the damper aperture 224. In other words, the damper aperture 224 may be formed in a longitudinal (e.g., vertical) direction of the housing 200 and thus oriented parallel to the piston 241. The relief flow passage 225 may be formed perpendicular to the damper aperture 224.

Furthermore, referring to a plan view of the hosing 200 perpendicular to the piston 241, the relief flow passage 225 may be inclined at a predetermined angle (θ) with respect to the discharge flow passage 223. To form the damper aperture 224 at a position to communicate with neither the chamber 221 nor the hollow part 220, the relief flow passage 225 that communicates with the discharge flow passage 223 and the damper aperture 224 may be formed to have the predetermined angle (θ) relative to the discharge flow passage 223. In other words, depending on the position at which the damper aperture 224 is formed, the angle (θ) between the relief flow passage 225 and the discharge flow passage 223 may be varied. The relief flow passage 225 may be formed within an angular range from 30° to 50° with respect to the discharge flow passage 223 although the angular range may be varied depending on the size of the housing 200 and the sizes of the chamber 221 and/or the hollow part 220.

The damper 230 may be disposed in an upper portion of the housing 200 and configured to reduce pulsation of fuel drawn through an inlet portion 251 coupled to a fuel tank (not shown) and then supply the fuel into the inlet flow passage 222 of the housing 200. Furthermore, the damper 230 may reduce pulsation of fuel which occurs when the fluid is compressed by the operation of the piston 241. The damper 230 may have a well-known configuration, and therefore, detailed description thereof will be omitted.

The pressure relief valve 400 may include a valve body 410, an open-and-close unit 420, and a spring 430. The valve body 410 may be inserted into and coupled to the relief flow passage 225 and may include a through hole 411 through which fuel flows. The open-and-close unit 420 may open or close the through hole 411 of the valve body 410. A first end of the spring 430 may be supported by the open-and-close unit 420, and a second end thereof may be supported in the damper aperture 224. When the pressure of fuel drawn into the relief flow passage 225 is equal to or greater than a second pressure, the spring 430 may be elastically compressed. As shown in FIG. 2, the open-and-close unit 420 may be provided with a ball 421 and a spring holder 422.

In other words, in the pressure relief valve 400, when fuel is drawn into the relief flow passage 225 at or above the second pressure, the fuel may compress the ball 421 at or above the second pressure, to allow the ball 421 to move rearward (e.g., retrieve) while compressing the spring 430, thus opening the through hole 411 of the valve body 410. Accordingly, fuel discharged out of the valve body 410 through the through hole 411 may flow into the damper aperture 224 and then flow into the damper 230 and the space 227, whereby the pressure of fuel that is discharged to the discharge flow passage 223 may be reduced. Further, an insert depression 226 may be formed in the damper aperture 224 to allow the second end of the spring 430 to be inserted into and coupled to the insert depression 226.

For the high-pressure fuel pump in the related art, as shown in FIG. 1, a flow passage is formed to cause fuel discharged through the pressure relief valve 60 to be supplied into the chamber 21. However, since high-pressure fuel is stored in the chamber 21, it is difficult for fuel passing through the pressure relief valve 60 to be effectively drawn into the chamber 21.

Conversely, in the high-pressure fuel pump 100 in accordance with the exemplary embodiment of the present disclosure, fuel that has passed through the pressure relief valve 400 may be drawn into the damper aperture 224. The damper aperture 224 may communicate with the damper 230 and the space 227, and low-pressure fuel may be stored in the damper 230 and the space 227. Thus, high-pressure fuel discharged through the pressure relief valve 400 may be drawn into the damper aperture 224. Consequently, the pressure of fuel that is discharged to the discharge flow passage 223 may be effectively reduced.

As described above, in a high-pressure fuel pump in accordance with the present disclosure, an open-and-close member of a discharge valve may be configured to make line contact with an inlet, to prevent a fluid sticking from occurring. Furthermore, in the present disclosure, the stroke of the open-and-close member in the discharge valve may be adjusted, whereby an impulsive noise which may occur when the open-and-close member elastically returns to its original position may be reduced, and the lifetime of the open-and-close member may be prevented from decreasing due to an impact during the returning operation.

While the present disclosure has been described with respect to the specific exemplary embodiments, the present disclosure is not to be limited to the disclosed exemplary embodiments and it will be apparent to those skilled in the art that various changes and modifications may be made without departing from the spirit and scope of the disclosure as defined in the following claims.

What is claimed is:

1. A high-pressure fuel pump comprising:

a housing including a chamber provided to compress fuel supplied thereinto, an inlet flow passage that communicates with the chamber to draw the fuel into the chamber through the inlet flow passage, and a discharge flow passage that communicates with the chamber to discharge the fuel out of the chamber through the discharge flow passage;

a piston disposed in the housing and configured to linearly reciprocate to compress the fuel supplied into the chamber;

a discharge valve disposed in the discharge flow passage of the housing and configured to open when a pressure of the fuel stored in the chamber is equal to or greater than a first pressure, the discharge valve including an open-and-close member that makes line contact with an inlet of the discharge valve to close the inlet;

a damper disposed in an upper portion of the housing, and configured to reduce pulsation of the fuel drawn thereinto through an inlet port and then supply the fuel to the inlet flow passage of the housing;

a sleeve coupled to the housing and configured to support the piston and form a space for storing the fuel within the housing; and a pressure relief valve disposed in a relief flow passage formed in the housing and communicates with the distance flow passage and the space, the pressure relief valve being configured to open when a pressure of the fuel supplied into the relief flow passage is equal to or greater than a second pressure, wherein one side of the piston compresses the fuel supplied to the chamber, and the sleeve supports the other side of the piston, and the space is formed along the outer circumference of the piston, and wherein the housing includes a damper aperture that directly communicates with the damper and the space, and the relief flow passage is formed to communicate with the discharge flow passage and the damper aperture.

2. The high-pressure fuel pump according to claim 1, wherein the discharge valve comprises:

a valve housing inserted into and coupled to the discharge flow passage, and having the inlet through which the fuel is drawn into the valve housing;

the open-and-close member slidably disposed in the valve housing to open or close the inlet, and having a ball shape to abut the inlet;

a valve sleeve inserted into and coupled to the discharge flow passage, and having an outlet through which the fuel is discharged out of the discharge valve; and a spring disposed between the open-and-close member and the valve sleeve, and configured to be compressed when the pressure of the fuel discharged to the discharge flow passage is equal to or greater than the first pressure.

3. The high-pressure fuel pump according to claim 2, wherein the valve housing comprises:

a housing body formed in a cylindrical shape, and having an inlet in a front surface thereof the inlet having a diameter less than a diameter of the open-and-close member, the housing body having an open rear surface;

a plurality of guide parts radially formed on an inner circumferential surface of the housing body at positions spaced apart from each other at regular angular intervals, the plurality of guide parts that abut an outer circumferential surface of the open-and-close member to guide movement of the open-and-close member; and flow passage parts formed between the plurality of guide parts and having a radius greater than a radius of the open-and-close member from a center of the housing body, the flow passage parts allowing the fuel to flow therethrough when the open-and-close member opens the inlet.

4. The high-pressure fuel pump according to claim 3, wherein the discharge valve controls a stroke in which the open-and-close member is configured to move when the pressure of the fuel stored in the chamber is equal to or greater than the first pressure.

5. The high-pressure fuel pump according to claim 4, wherein the valve sleeve comprises:

a sleeve body having a cylindrical shape and including an open front surface, with an outlet formed in a rear surface of the sleeve body to discharge the fuel out of the sleeve body through the outlet, the sleeve body being inserted into and coupled to the discharge flow passage at a position spaced apart from the housing body by a predetermined distance; and a stopper that protrudes from a central portion of the sleeve body toward the open-and-close member, with the spring fitted over the stopper, the stopper being configured to limit the stroke of the open-and-close member, wherein the stroke of the open-and-close member is controlled by adjusting a position of the sleeve body coupled to the discharge flow passage.

6. The high-pressure fuel pump according to claim 4, wherein the valve sleeve comprises:

a sleeve body having a cylindrical shape and including an open front surface, with an outlet formed in a rear surface of the sleeve body to discharge the fuel out of the sleeve body through the outlet, the sleeve body being coupled to the housing body by a threaded coupling; and a stopper that protrudes from a central portion of the sleeve body toward the open-and-close member, with the spring fitted over the stopper, the stopper being configured to limit the stroke of the open-and-close member, wherein the stroke of the open-and-close member is controlled by rotating the sleeve body and adjusting a distance between the sleeve body and the housing body.

7. The high-pressure fuel pump according to claim 1, wherein, based on a plan view of the housing perpendicular to the piston, the relief flow passage is inclined at a predetermined angle with respect to the discharge flow passage.

8. The high-pressure fuel pump according to claim 1, wherein the pressure relief valve comprises:

a valve body inserted into and coupled to the relief flow passage, and having a through hole through which the fuel flows;

an open-and-close member configured to open or close the through hole of the valve body; and a spring including a first end supported by the open-and-close member, and a second end supported in the damper aperture, the spring being elastically compressed when a pressure of the fuel drawn into the relief flow passage is equal to or greater than a second pressure.

* * * * *